US009528786B2

(12) United States Patent
Chance et al.

(10) Patent No.: US 9,528,786 B2
(45) **Date of Patent: *Dec. 27, 2016**

(54) SAFETY SYSTEM AND METHOD FOR REMOTELY DISABLING A WEAPON

(71) Applicants: Donald Eugene Chance, Watkinsville, GA (US); Dennis Harold Pitts, Lee, GA (US); Wayne Kenneth Osborne, Lawrenceville, GA (US)

(72) Inventors: Donald Eugene Chance, Watkinsville, GA (US); Dennis Harold Pitts, Lee, GA (US); Wayne Kenneth Osborne, Lawrenceville, GA (US)

( * ) Notice: Subject to any disclaimer, the term of this patent is extended or adjusted under 35 U.S.C. 154(b) by 233 days.

This patent is subject to a terminal disclaimer.

(21) Appl. No.: 14/265,210

(22) Filed: Apr. 29, 2014

(65) Prior Publication Data

US 2014/0230301 A1 Aug. 21, 2014

Related U.S. Application Data

(63) Continuation of application No. 12/998,088, filed as application No. PCT/US2008/011743 on Oct. 15, 2008, now Pat. No. 8,740,026.

(Continued)

(51) Int. Cl.

| | |
|---|---|
| ***F41A 17/46*** | (2006.01) |
| ***F41A 17/06*** | (2006.01) |
| ***F41C 33/02*** | (2006.01) |

(52) U.S. Cl.

CPC ..... *F41A 17/063* (2013.01); *F41A 17/46* (2013.01); *F41C 33/0209* (2013.01)

(58) Field of Classification Search

CPC ..... F41C 33/02; F41C 33/0209; F41A 17/063; F41A 17/46

(Continued)

(56) References Cited

U.S. PATENT DOCUMENTS

| | | | |
|---|---|---|---|
| 3,530,451 | A | 9/1970 | Devine |
| 5,603,180 | A | 2/1997 | Houze |

(Continued)

FOREIGN PATENT DOCUMENTS

| | | |
|---|---|---|
| WO | WO2010039111 | 4/2010 |

OTHER PUBLICATIONS

Notification and Transmittal of the International Search Report and Written Opinion, dated Dec. 16, 2009 and issued in International Application No. PCT/US2008/011743. (11 pages).

*Primary Examiner* — Corey Skurdal

(74) *Attorney, Agent, or Firm* — Robert Z. Evora, Esq.

(57) ABSTRACT

A weapon including a first portion of a disarming protection circuit integrated into a removable magazine clip. The first portion of the disarming protection circuit is integrated into the magazine clip and includes, a high voltage source, a receiver for receiving a signal from a transmitter and an output. A second portion of the disarming protection circuit includes a conductor assembly including an electrode that extends adjacent to an inside wall of a magazine compartment. The first end of the electrode is electrically connected to a conductor connection adjacent to the output of the first portion of the circuit. A second end of the electrode is disposed through the handle and is exposed from outside the handle. An actuator generates the signal that connects the high voltage source in the circuit to the electrode in response to the output from the receiver. In response to the actuator being activated, the high voltage current source produced is electrically communicated through the electrode into the handle of the weapon with a sufficient shock to cause a person to release the weapon.

17 Claims, 7 Drawing Sheets

Related U.S. Application Data

(60) Provisional application No. 61/195,075, filed on Oct. 4, 2008.

(58) Field of Classification Search
USPC ..... 42/70.01, 70.06, 70.11
See application file for complete search history.

(56) References Cited

U.S. PATENT DOCUMENTS

| | | | | |
|---|---|---|---|---|
| 6,223,461 | B1 * | 5/2001 | Mardirossian | F41A 17/06 42/70.11 |
| 6,320,975 | B1 | 11/2001 | Vieweg | |
| 6,412,207 | B1 | 7/2002 | Crye et al. | |
| 6,523,295 | B1 | 2/2003 | Midgley | |
| 6,876,756 | B1 | 4/2005 | Vieweg | |
| 8,205,372 | B2 | 6/2012 | Anzeloni | |
| 2008/0000130 | A1 | 1/2008 | Mauch et al. | |

* cited by examiner

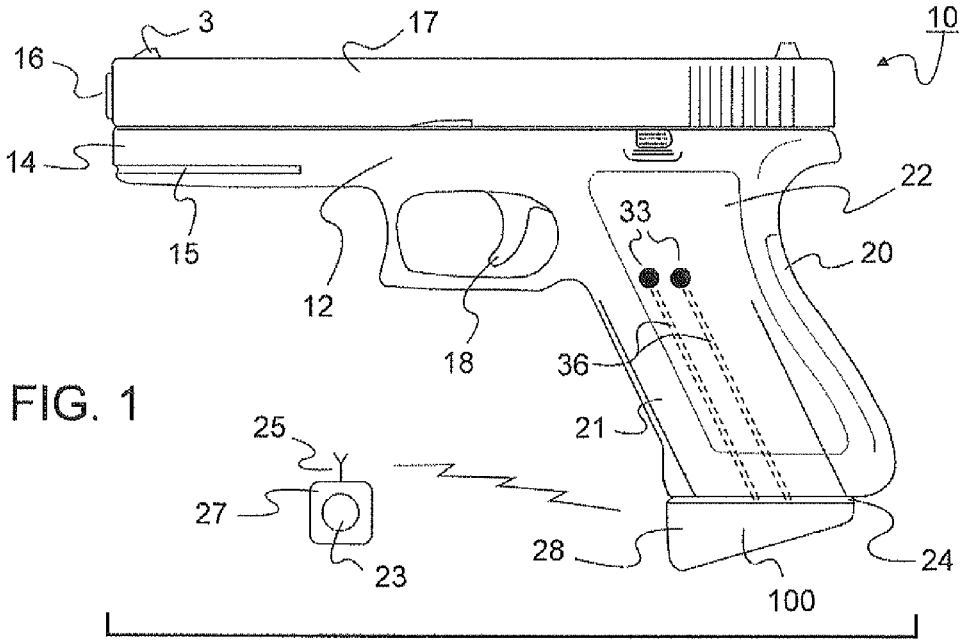
FIG. 1
FIG. 2
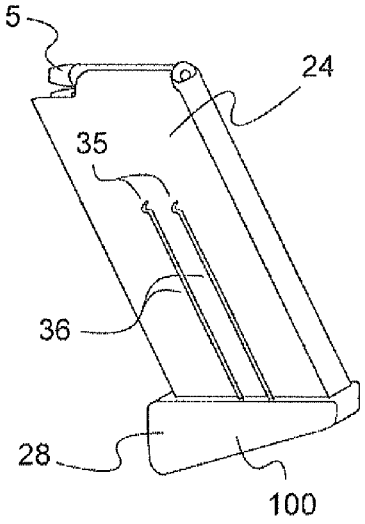
FIG. 3
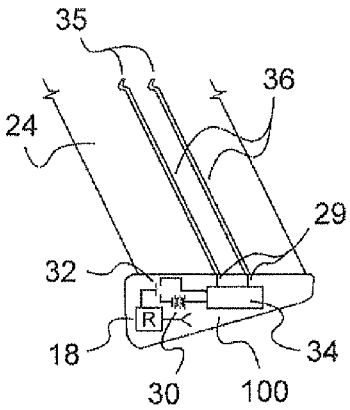
FIG. 4
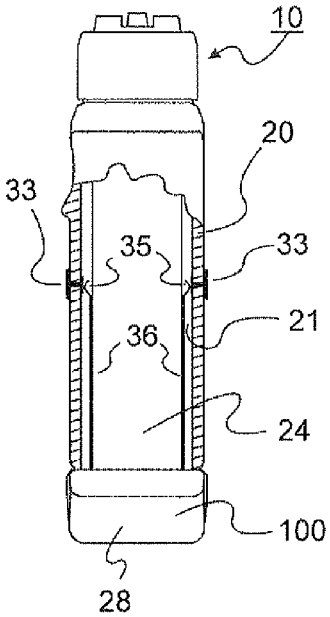

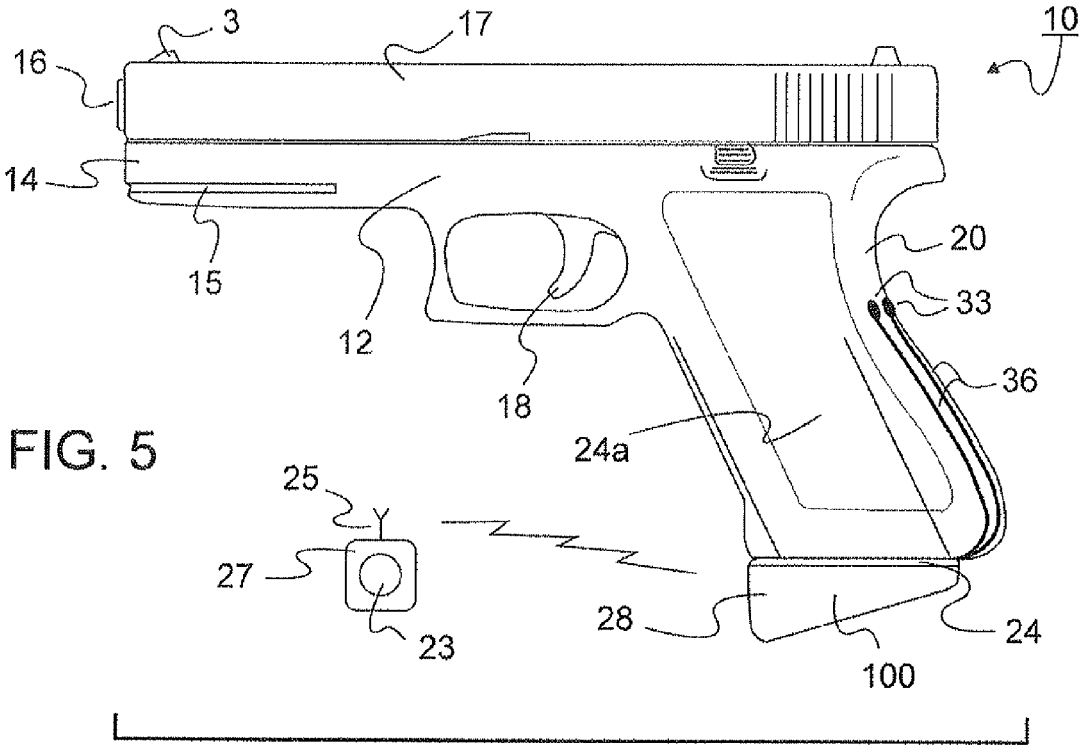
FIG. 5
FIG. 6
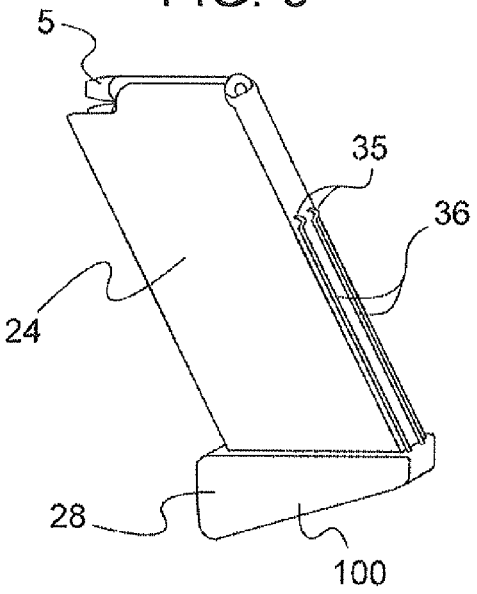
FIG. 7
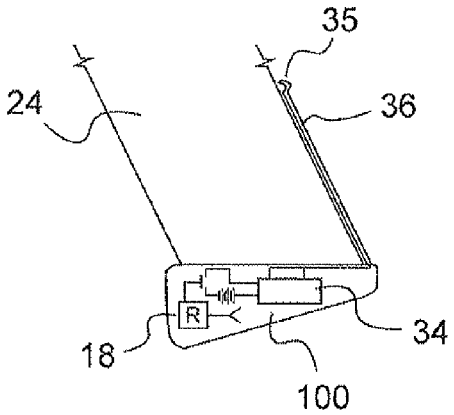

SAFETY SYSTEM AND METHOD FOR REMOTELY DISABLING A WEAPON

CROSS REFERENCE TO RELATED APPLICATIONS

This application is a continuation which claims the benefit of the filing date of U.S. Non-Provisional application Ser. No. 12/998,088 filed on Mar. 16, 2011, which is a 371 of International Application PCT/US2008/011743 filed Oct. 15, 2008, the entirety of which is incorporated herein; which also claims the benefit of the filing date of U.S. Provisional Application Ser. No. 61/195,075 filed on Oct. 4, 2008, the entirety of which is also incorporated herein.

BACKGROUND

1. Field

This invention relates to a safety system for a weapon, and more particularly, to a safety system for disabling a weapon by use of an electronic disabling mechanism.

2. Description of the Related Art

Being a law enforcement officer is a dangerous profession. All too often, officer's deal with unscrupulous individuals who have little regard for the safety of others, and even less regard for the safety of the law unenforcement officer. Law enforcement officers frequently encounter situations where an offender is to be neutralized and arrest. Frequently, a scuffle may ensue between the officer and the perpetrator in which both try to gain possession of the officer's weapon.

Although an officer is trained in techniques to prevent the felon from disarming them, these techniques are not full proof, and oftentimes, the offender may overpower the officer and gain control of the weapon. The grave concern then is that the felon will use the officer's own gun to shoot him. Unfortunately, this is an imminent concern as many police officer's are shot and killed each year by perpetrator's who shoot them with their own weapon.

Various proposed solutions have been proposed to lessen the likelihood of a perpetrator disarming the officer and being able to use the officer's weapon against him. One such example includes U.S. Pat. No. 5,603,180 which requires the entire handle of a revolver to be replaced with a modified handle including circuitry for disarming an assailant. The disadvantage of this concept, as well as various other conventional proposed solutions, is the weapon must be significantly altered to embed all of the circuitry within the handle of the revolver. This process is cumbersome, very costly and/or not easily adaptable for a conventional revolver as originally purchased by a consumer. Although not shown, the firing pin arrangement would have to be substantially modified to account for these traditional proposed solutions thereby rendering these solutions awkward, expensive and require extensive modifications to the revolver.

There is still a longstanding need to provide a non-lethal solution to the problem of disarming and temporarily incapacitating a person carrying a weapon without doing substantial long-term damage. In accordance with this invention, an exemplary safety system is proposed for disarming a felon from using the weapon by use of an electronic disabling mechanism.

SUMMARY

The present invention provides systems and methods for a weapon equipped with an immobilizing and disarming protection circuit.

An object of this invention is to provide a weapon including a first portion of a disarming protection circuit integrated into a removable magazine clip. The first portion of the disarming protection circuit is integrated into the magazine clip and includes, a high voltage source, a receiver for receiving a signal from a transmitter and an output. A second portion of the disarming protection circuit includes a conductor assembly including an electrode that extends adjacent to an inside wall of a magazine compartment. The first end of the electrode is electrically connected to a conductor connection adjacent to the output of the first portion of the circuit. A second end of the electrode is disposed through the handle and is exposed from outside the handle. An actuator generates the signal that connects the high voltage source in the circuit to the electrode in response to the output from the receiver. In response to the actuator being activated, the high voltage current source produced is electrically communicated through the electrode into the handle of the weapon with a sufficient shock to cause a person to release the weapon.

Another aspect of the invention is to provide conductive coverings that may be disposed on any surface of the weapon that would be gripped by the user of the weapon.

According to this invention, a removable rail mounted housing may be integrated that houses the disarming protection circuit. The removable rail would house the high voltage power source, the receiver for receiving a signal from a transmitter and providing the high voltage output. As before, the conductor assembly, or a second portion of the disarming protection circuit disarming protection circuit, would include an electrode that extends from the removable rail mounted housing to a grip on the weapon. The first end of the electrode may be electrically connected to a conductor connection electrically connected to the output of the first portion of the high voltage producing circuit. In response to a switch being activated, the disarming protection circuit would generate the high voltage output through the conductor connection to the electrode.

Yet, in another aspect of this invention, the automatic weapon may include a trigger blocking mechanism locks the trigger so that the weapon cannot be fired. The trigger blocking mechanism may include a blocking member that extends into a recess formed in the trigger thereby locking the trigger and preventing the trigger from being pulled.

According to systems and methods of this invention, an immobilizing and disarming control system for a weapon is provide including a barrel having a muzzle, a trigger and a handle. The control system includes a high voltage producing circuit. A first portion of the high voltage producing circuit including a high voltage power source, a receiver for receiving a signal from a transmitter and providing a high voltage output to an electrode exposed through the handle.

A second portion of the high voltage producing circuit including a conductor assembly including a conductive sheath electrically connected to the electrode that is overlaid onto the grip of the handle. In response to the a switch being activated, a trigger blocking mechanism locks the trigger so that the weapon cannot be fired; and an actuator produces the signal that generates and delivers the high voltage output through the electrode to the conductive sheath.

Another aspect of this invention is to provide a method of controlling the operation of, and disarming, a weapon by an authorized person to prevent operation by an unauthorized person. The method includes the steps of providing at least one high voltage electrode on a grip of the weapon. In response to the actuation of a switch, activating a disarming protection circuit and delivering a high voltage current source through the disarming protection circuit into an electrode into the grip of the weapon with a sufficient shock to cause a person to release the weapon.

Another aspect of this invention is to provide a holster assembly for a weapon. The holster assembly includes a pouch for receiving the weapon. The holster including a high voltage circuit having an actuator that generates an instruction signal to provide a high voltage current source to an output in the high voltage circuit. An electrode is electrically connected to, and extends from, the output in the high voltage circuit to a conductor connection exposed inside of the pouch that holds the weapon. In response to a switch on the holster being activated, the high voltage current source actuator generates the instruction signal that produces the high voltage current source through the electrode to the conductor connection disposed in the pouch.

A weapon may be used in combination with the holster. The weapon may include a conductive covering which is fastened to the surface of the weapon. The conductive covering is electrically connected to the conductor connection exposed inside of the pouch of the holster. A surface of the conductive covering is disposed in juxtaposition to the conductor connection, and extends over a portion of a grip of the handle of the weapon. In response to the switch on the holster being activated, a trigger blocking mechanism may be locked so that the trigger cannot be pulled. Simultaneously, the high voltage current source produced is electrically connected through the conductor connection disposed in the pouch into the conductive covering on the weapon with the high voltage current source sufficient to cause a person to release the weapon.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein:

FIG. 1 illustrates an exemplary embodiment of a weapon and the disarming protection circuit in accordance with this invention.

FIG. 2 illustrates an exemplary magazine for the disarming protection circuit in accordance with this invention.

FIG. 3 depicts the magazine and disarming protection circuit in accordance with this invention.

FIG. 4 shows an exemplary rear view cut-away view of the handle of the weapon and magazine illustrating an exemplary electrode connection in accordance with this invention.

FIG. 5 illustrates another exemplary embodiment for the electrode arrangement in the weapon in accordance with this invention.

FIGS. 6-7 depict another embodiment for the magazine and disarming protection circuit in accordance with this invention.

DETAILED DESCRIPTION OF EXEMPLARY EMBODIMENTS

Figure 8:
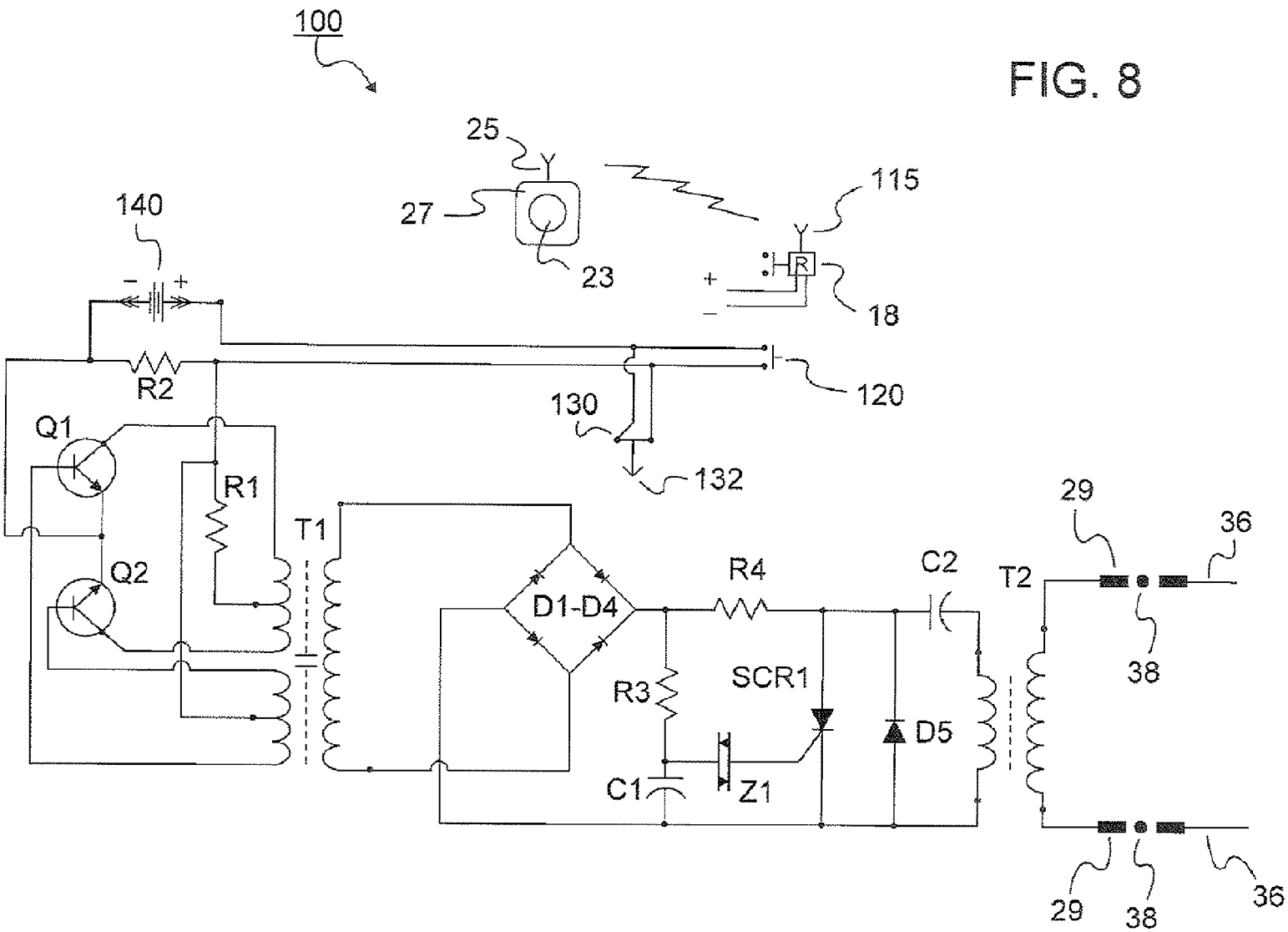
FIG. 8 illustrates an exemplary schematic circuit diagram for the disarming protection circuit in accordance with this invention.

Particular embodiments of the present invention will now be described in greater detail with reference to the figures.

FIG. 1 illustrates a weapon 10 in accordance with this invention. For exemplary purposes, the weapon 10 may be a semi-automatic hand gun. As shown, the weapon 10 is made up of a frame 12 including a barrel 14, a rail 15, a muzzle 16, a slide cover 17 with a sight 3, a trigger 18, a handle 20 having a hand grip 22, and a magazine 24 used to store and deliver bullets 5 in line with a firing pin (not shown) during operation.

Although a semi-automatic hand gun type weapon is shown in this example, it is to be understood that the weapon 10 may be selected from any number of various types of weapons, such as but not limited to: a hand gun, a revolver, a rifle, a semi-automatic assault rifle, and/or any type of weapon, or the like, now known or later discovered in accordance with systems and methods of this invention.

FIGS. 2-3 illustrate another aspect of the systems and methods of this invention in which the weapon 10 includes an immobilizing and disarming protection circuit 100 integrated as part of the weapon 10. One aspect of this invention is to easily retrofit already existing commercially available weapons by integrating the disarming protection circuit 100 and other features described herein onto the weapon.

The disarming protection circuit 100 may be housed within a component that may be retrofitted onto a commercially available weapon, and/or produced anew within a modular component that may be attached on any number of various positions on the weapon 10 as will be described herein.

Under the control of an authorized person, the disarming protection circuit 100 operates to immobilize and disarm an unauthorized person attempting to use the weapon 10 against the disarmed authorized person. In particular, when the disarming protection circuit 100 is activated by the authorized person, a large electrical voltage is generated within the disarming protection circuit 100 and delivered through the weapon 10 into the body of the unauthorized person holding the weapon 10 thereby causing the unauthorized person to release the weapon.

As shown in FIG. 1, the disarming protection circuit 100 may be activated by an actuator 27. The actuator 27 may be a remote and/or wireless actuator or may be a tethered actuator connected to the circuitry of the disarming protection circuit 100. In FIG. 1, the actuator 27 is a remote actuator that wirelessly communicates with the disarming protection circuit disarming protection circuit 100. As a remote wireless actuator 27, the actuator 27 includes a transmitter 25 adapted to generate and send an instruction signal to activate the disarming protection circuit disarming protection circuit 100. Upon activation, the disarming protection circuit 100 will to generate and administer an excessive disarming high voltage to the unauthorized person who is wrongly in possession of the weapon 10. The remote wireless actuator 27 is portable and may be carried by the owner or authorized user of the weapon 10.

FIGS. 2-3 better illustrate the magazine 24 including an extension 28 in which a first portion of the electronics of the disarming protection circuit 100 is embedded in accordance with systems and methods of this invention. That is, the first portion of the disarming protection circuit 100 is housed within the extension 28 of the magazine 24 and is adapted to receive the instruction signal, from the transmitter 25 in the actuator 27, to generate a high voltage.

Unlike conventional systems, an aspect of this invention is to modify an existing weapon with little expense and modification to the original structure of the weapon. In accordance with this exemplary embodiment, little modification is required to integrate the disarming protection circuit 100 because the conventional magazine originally purchased could merely be exchanged for a magazine 24 with an extension 28 including the circuitry of the first portion of the disarming protection circuit 100 in accordance with this invention.

As shown generally in FIG. 3, the circuitry of the first portion of the disarming protection circuit 100 housed within the magazine 24 may include at least a battery 30, a switch 32, a high voltage transformer 34, and at least one high voltage output terminal 29, all being electrically connected to each other.

FIGS. 1-3 also show a second portion of the disarming protection circuit 100. The second portion of the disarming protection circuit 100 includes at least one electrode 36 connected to, and extending away from, the high voltage output terminal 29 within the circuitry of the disarming protection circuit 100. The electrode 36 extends outward to an electrode end 35. The electrode end 35 electrically connects the output terminal 29 via extension of the electrode 36 to a predetermined position extended along the handle 20 of the weapon 10. As shown, the electrode 36 terminates into the pair of electrodes ends 35 which rest adjacent to contact electrodes 33 disposed in the handle 20. The contact electrode 33 is preferably exposed through the handle 20 of the weapon 10 so that a surface of the contact electrode 33 will come into contact with the hand or fingers of a person gripping the weapon 10.

Figure 12:
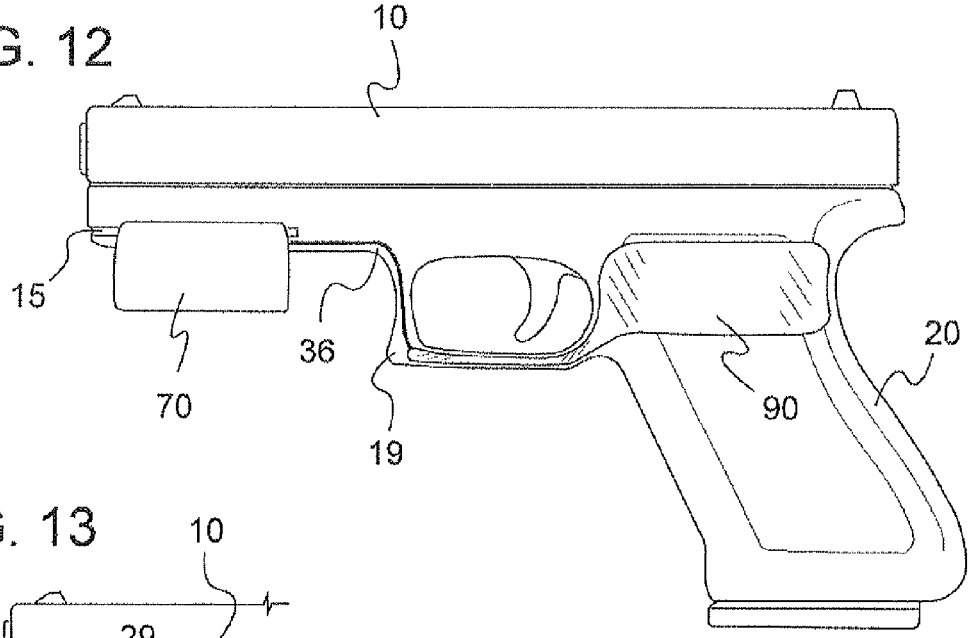
FIG. 12 illustrates an exemplary embodiment for a rail mounted housing assembly including the disarming protection circuit and the conductive covering in accordance with this invention.
Figure 15:
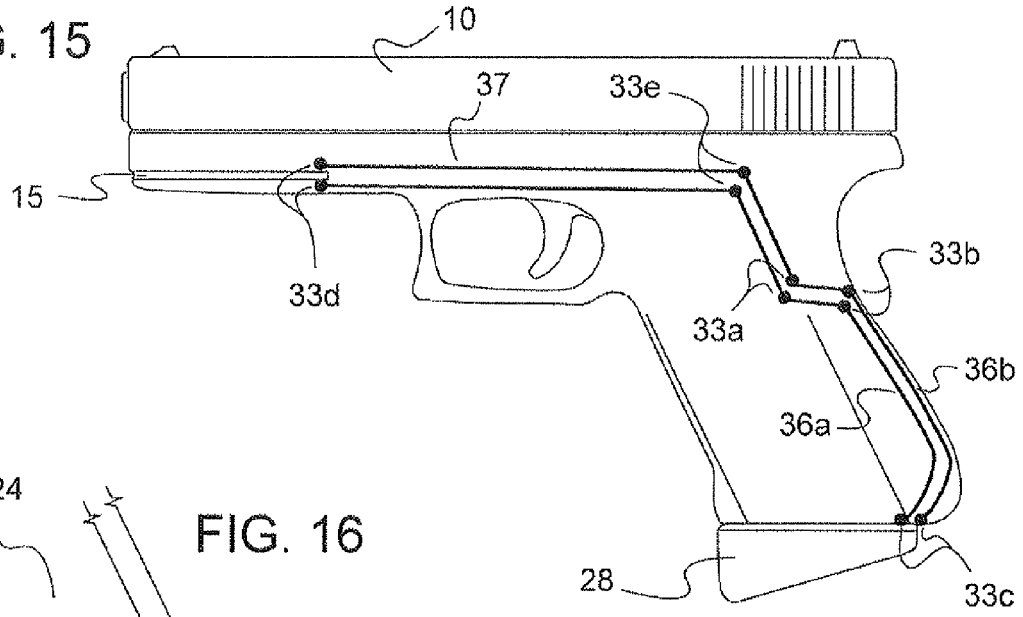
FIG. 15 illustrates an exemplary electrode circuit integrated with the weapon in accordance with this invention.

It is to be understood that the electrodes 36 may be constructed in any suitable arrangement. That is, the electrodes 36 may be disposed on an outside, or, on an inside of the handle 20. By way of example, FIG. 1 depicts the electrodes 36 extending from the disarming protection circuit 100 in a side-by-side arrangement inside of the handle 20 of the weapon 10. It is within the scope of this invention to also place the electrodes 36 on an outside (as will be described in more detail later) of the handle 20 of the weapon 10. As will also be described later, a conductive covering 90 (as shown in FIGS. 12 and 15) electrode material may be laid over the handle 20 of the weapon 10 also to electrically connect the disarming protection circuit 100 to the grip 22 of the weapon 10.

Referring back to FIG. 1, the electrodes 36 are shown extending in hidden lines along an internal magazine receiving compartment 24*a* inside of the handle 20 of the weapon 10. The electrodes may be disposed on an internal surface of the internal magazine receiving compartment 24*a* up to the position where the contact electrodes 33 meet the electrodes 36.

FIGS. 2-3 illustrate the electrodes 36 being disposed on an outside of the magazine 24 casing in accordance with another aspect of this invention. In this configuration, electrode ends 35 of the electrodes 36 are disposed on the magazine 24 may come into contact with an inside surface of the contact electrode 33 which extends through the handle 20. The contact electrode 33 has an outer surface end exposed on the outside of the handle 20 at a location that is aligned with the electrode ends 35 of the electrode 36. According to this configuration, only a pair of holes would have to be bored into the handle 20 and the pair of contact electrode 33 would have to be placed therein to provide electrical connection back to the disarming protection circuit 100.

FIG. 4 depicts another exemplary rear view breakaway illustration of the weapon 10 in which the electrodes 36 are disposed on an outside of the magazine 24 casing. In this case, the electrodes 36 extend up along both sides of the handle 20 to a pair of electrode ends 35. The contact electrodes 33 are shown placed through the handle 20 on each side of the handle 20. The electrode ends 35 of the electrodes 36 are shown connected to the contact electrodes 33 which are exposed on the outside of the handle 20, at a location aligned with the electrode ends 35.

According to this configuration, two holes may be bored in the handle 20, one on each side of the handle 20 into which the contact electrodes 33 may be placed. When activated, the contact electrodes 33 will be electrically connected with the high voltage output 29 source that is delivered from the disarming protection circuit 100.

FIGS. 5-7 illustrate another exemplary embodiment in which the electrodes 36 are arranged, and disposed, along the back side of the handle 20. As shown slightly offset from the rear surface of the weapon 10, the electrodes 36 extend up from the disarming protection circuit 100 located in the extension 28 of the magazine 24 to a predetermined contact point adjacent to a location over which a user would place their hand during operation of the weapon 10.

Various arrangements for the electrodes 36 is possible, such as for example, the electrodes 36 may be extended inside of the magazine channel 24*a* of the weapon 10 to a location adjacent to the electrode ends 33, at which point the electrode ends 33 are disposed through the handle 20. Alternatively, the electrodes 36 may be run over the outside of the handle 20 of the weapon 10, as will be described later.

FIGS. 5-7 also demonstrate the arrangement of the electrodes 36 on a back end surface of the magazine 24. In this configuration, the electrode ends 35 of the electrodes 36 are disposed on the back end of the magazine 24 and come into contact with a contact electrode 33 when the magazine 24 is placed within the magazine compartment 24*a*.

A similar electrical connection construction as shown in FIG. 4 may be applied to the back end of the handle 20. That is, the electrode ends 35 come into contact with the contact electrode 33 disposed in the handle 20, which in turn extend through the handle and have a surface exposed on an outside back portion of the handle 20. A pair of holes may be bored into the back side of the handle 20 to receive the pair of contact electrodes 33 that would provide electrical connection back to the disarming protection circuit 100.

As will be described later, it is within the scope of this invention to fasten the electrodes 36 to an outside rear surface of the handle 20 of the weapon 10 in a configuration that would resemble the illustration of FIG. 5. According to this exemplary embodiment, the contact electrodes 33 would be directly connected to the electrodes 36, and the contact electrodes 33 would be suitably located to come into contact with the unauthorized user's hand.

FIG. 8 shows a schematic diagram of a weapon disablement and disarming protection circuit 100 according to an embodiment of the invention. In general, the disablement protection circuit 100 converts a low voltage trigger input and transforms the low voltage trigger input into a high voltage output capable of disarming and disabling an unauthorized person with a severe shock applied to the body of the unauthorized individual who has, or is attempting to abscond, the authorized person's weapon.

The schematic diagram of the weapon disablement and disarming protection circuit 100 shown is FIG. 8 is shown for exemplary purposes. It is to be understood that other suitable disabling and disarming protection circuits may be used in accordance with systems and methods of this invention.

An advantage of the features of this invention is to provide a simple and inexpensive technique in which a law enforcement officer (military personnel, or other person authorized to carry a weapon) may prevent his or her own weapon from being taken and used against him. It is to be understood that this invention has widespread application among various types of personal entrusted with a weapon, including, but not limited to, law enforcement, military, and the like.

In general, the disarming protection circuit 100 is a battery 140 operated mechanism integrated into the weapon according to systems and methods of this invention. The battery 140 of the disarming protection circuit 100 supplies electricity to the disarming protection circuit 100 consisting of various electrical components. The circuitry may include multiple transformers, components that boost the voltage in the circuit, typically to between 20,000 and 1,000,000 volts, and reduce the amperage. It may also include an oscillator (to fluctuates the high voltage current to produce a specific pulse pattern of electricity), or an intermittent flash drive power source (like a flasher and/or strobe effect) that will allow the high voltage current to intermittently charge and discharge the high voltage source thereby preventing the internal circuitry of the disarming protection circuit 100 from over heating and being damaged. Another advantage of providing the predetermined intermittent charge is to conserve the power source for extended use. This current charges a capacitor(s). The capacitor builds up a charge, and releases it to the high voltage terminals (or electrodes 36).

In brief, the disarming protection circuit 100 integrated onto the weapon 10 includes a first portion including an actuator, e.g., a switch (remote or tethered) that communicates with a voltage amplifier circuit from which at least one high voltage output terminal is output, and is capable of carrying an extremely high voltage. The first portion of the disarming protection circuit 100 may be removable from the weapon 10 and/or integrated within the weapon 10. A second part of the disarming protection circuit 100 extends the high voltage source from the high voltage terminals 29, through a pair of electrodes 36, away from the first portion onto a grip 22 portion of the weapon 10. In operation, the first portion is electrically connected from the output terminals 29 through a conductor connection into the second portion of the disarming protection circuit 100 including the electrodes 36 so that the high voltage can be delivered to the body of an unauthorized person attempting to use the weapon 10.

Activation of the disarming protection circuit 100 may be performed in various different ways. For example, FIG. 8 depicts at least two activation methods, one being remotely controlled and another being tethered. In the remote controlled activation, an actuator 27 including a transmitter 25 (when activated) generates an instruction signal instructing the disarming protection circuit 100 to begin the high voltage energizing operation.

The remote activation switch (herein remote actuator 27) may be implemented in a variety of different ways. For example, in a first exemplary embodiment, the remote actuator 27 may be embodied as a remote control relay switch. That is, the remote actuator 27 may include a remote battery operated push button device constructed like a key fob for opening and/or locking a vehicle door. The remote actuator 27 includes a transmitter 25. The remote actuator 27 includes a battery source (not shown) connected to a switch 23 across a resistor (not shown), and to an antennae (shown in FIG. 8). In use, when the switch 23 is depressed, the remote actuated circuit is closed and the battery source is connected across the resistor and generates an instruction signal instructing the disarming protection circuit 100 to begin operation. The instruction signal is transmitted from the transmitter 25 to a receiver 115 disposed on the weapon 10.

The transmitter 25 may be a single signal generator operating at any suitable frequency in a radio frequency range from a low audio range up to as high as 10 GHz. As desired, a suitable identifying code may be incorporated into the signal emitting from the transmitter 25 so a receiver/decoder 18 reacts only to a signal from the predetermined transmitter 25.

Figure 10:
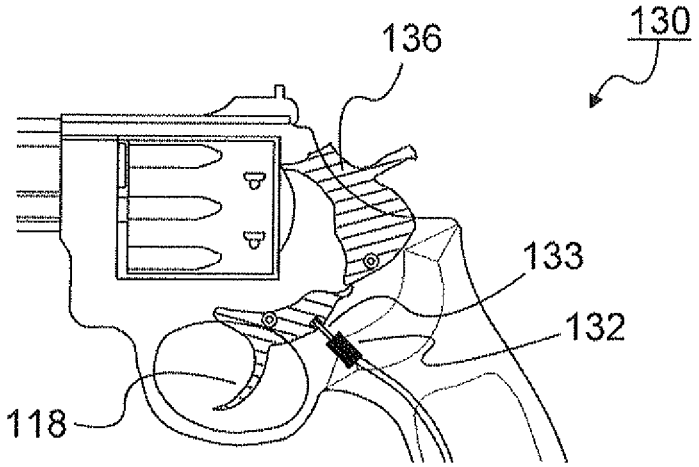
FIG. 10 depicts an exemplary embodiment in which a weapon includes a trigger blocking mechanism in a closed configuration according to this invention.

A receiver/decoder 18 may be provided to receive the incoming actuation instruction signal from the transmitter 25 and to close the circuit at a switch 18*a* (as shown in FIG. 10). The transmitter 25 may use a variety of various types of transmit protocols. By way of example, the various types of RF frequency communication protocols may be suitably used and may include, but are not limited to, a radio frequency transmitter, near field communication, Bluetooth, and/or any other type of wireless communications protocol suitable for transmitting an instruction signal from the transmitter 25. Other known RE frequency communication mediums may include those described and shown in U.S. Pat. Nos. 3,939,679, 4,003,152, 4,089,195, 4,488,370, 4,811,775, 4,843,336, and 5,603,180 to which reference is made for a more complete description. Likewise, various types of security protocols may be used to ensure the security of the signal transmission, including, but not limited to, cipher link technology, secure socket technology, rolling code and/or multi-channel hopping technologies, and various other types of secure technologies, which are now known or later discovered in accordance with this invention.

As shown in FIGS. 1 and 8, the receiver/decoder 18 embedded within the extension 28 of the magazine 24 may be equipped with an antenna 19 and is arranged to receive and decode, if necessary, the instruction signal from the transmitter 25. The receiver/decoder 18 may be of any suitable type, such as shown in U.S. Pat. Nos. 3,939,679, 4,003,152, 4,089,195, 4,488,370, 4,811,775 and 4,843,336 to which reference is made for a more complete description.

In the alternative, the receiver/decoder 18 may be adapted to receive a remote instruction signal from some other authorized source at a different remote location, such as a central station. In the instance where a peace officer is disabled and/or rendered unconscious, another individual may report the incident and/or missing weapon to a central station. The central station may independently actuate the operation of the disarming protection circuit 100 remotely with another transmitter 25 source from the central station to initiate operation of the disarming protection circuit 100 and cause the weapon 10 to emit the excessive high voltage shock to the assailant while he is attempting to make a get-away with the stolen weapon 10. The shock delivered would remotely incapacitate the assailant. It is another aspect of this invention to integrate a location based locating system (not shown), such as for example, Global Positioning System technology, and/or other wireless communication protocols, or the like, into the weapon 10 so that the weapon 10 may be remotely located if the unauthorized person absconds and flees with the weapon 10.

The instruction signal from the transmitter 25 is wirelessly transmitted from the transmitter 25 incorporated in the actuator 27 device. The actuator 27 device may be worn by the authorized user of the weapon 10. The transmitter 25 may be worn in any suitable manner, such as for instance on the belt, attached to the clothing, in a pocket, incorporated into a bracelet or the like.

Figure 11:
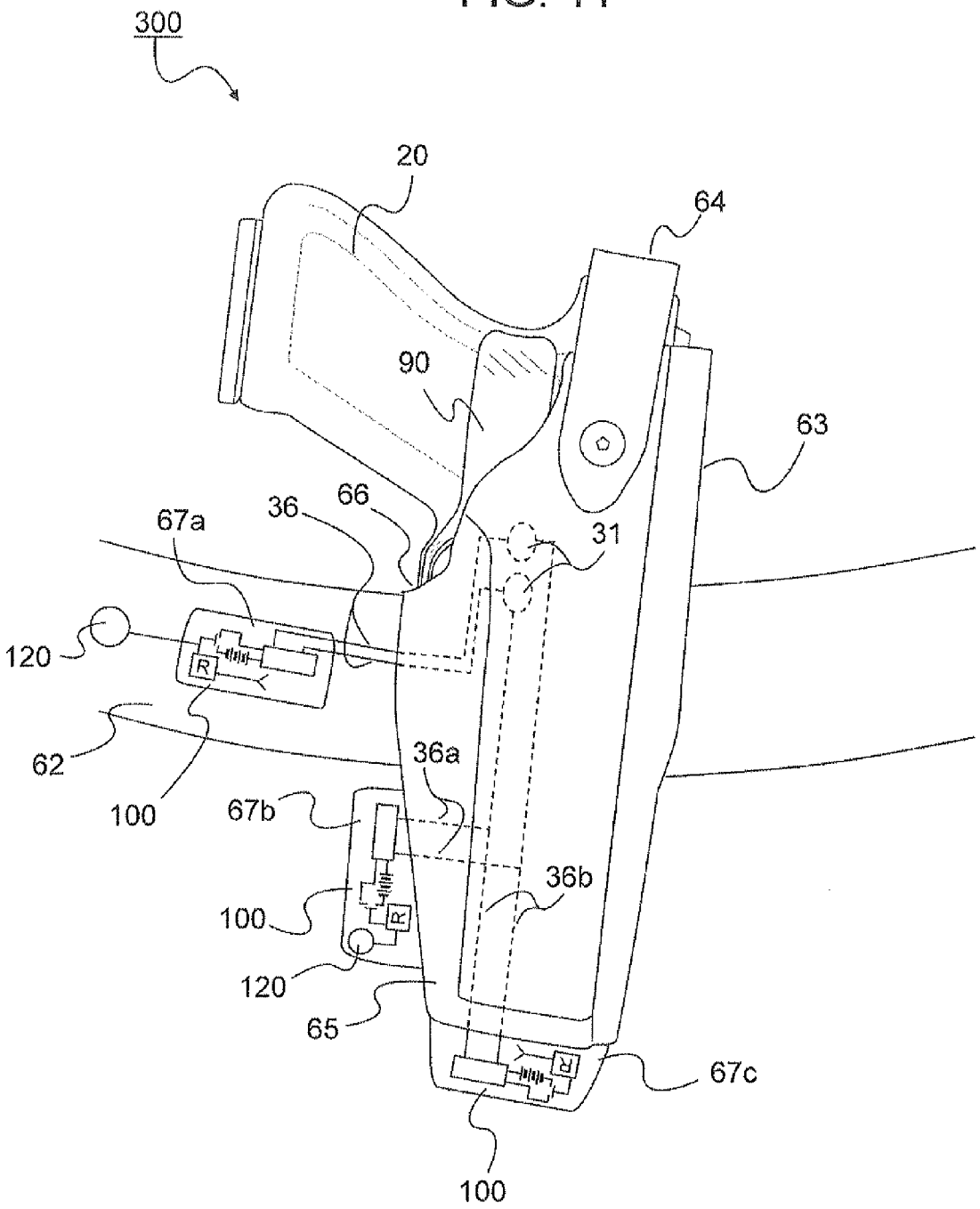
FIG. 11 shows an exemplary embodiment for a holster assembly including a weapon and the disarming protection circuit in accordance with this invention.

In the second alternative, the actuator 27 may be embodied as a remote push button switch 120 as shown in schematic representation in FIG. 8. In this embodiment, the push button switch 120 may be a remote push button switch (as shown in FIG. 11) integrated into the belt 62, or elsewhere, on the person authorized to carry the weapon 10. In operation, to activate the disarming protection circuit 100, the authorized user will depress the push button switch 120, which would in turn close the disarming protection circuit 100 and trigger a low voltage input signal.

Once the low voltage trigger input has been activated and the instruction signal is generated and received by the receiver/decoder 18, current will flow from the remote activation switch 110. A trigger blocking mechanism 130 may be embedded with the current flowing from the remote activation switch 110.

Figure 9:
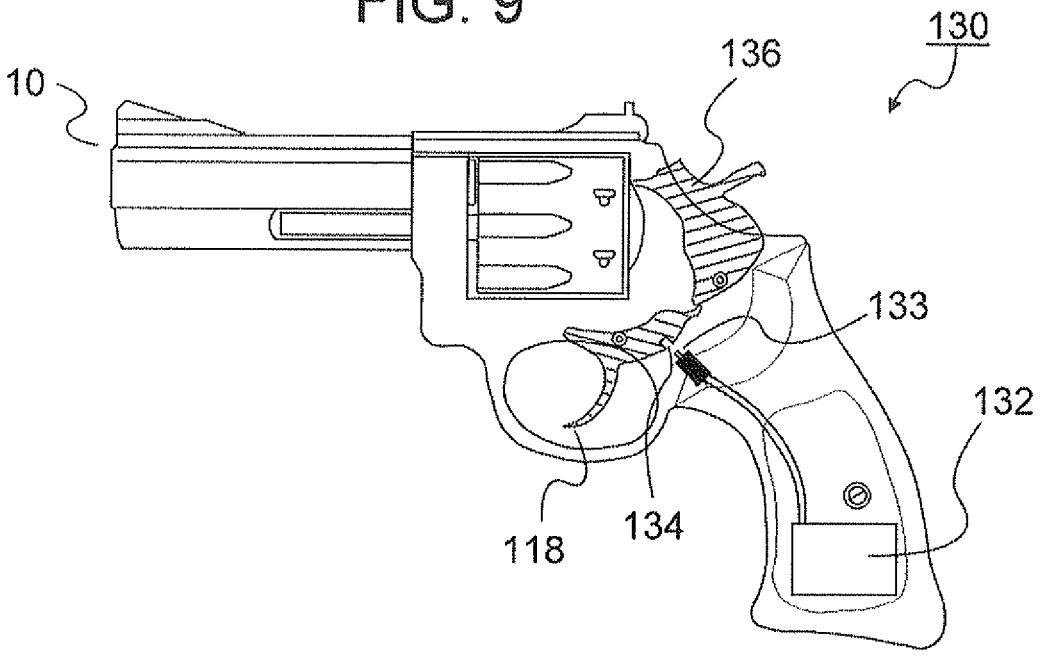
FIG. 9 depicts an exemplary embodiment in which a weapon includes a trigger blocking mechanism in an open configuration in accordance with this invention.

FIGS. 8-10 illustrate the trigger blocking mechanism 130. FIG. 8 depicts a schematic representation of the trigger blocking mechanism 130. As shown in FIG. 9, the trigger blocking mechanism 130 includes a plunger switch 132 located adjacent to the trigger 118. In operation, the plunger switch 132 is energized and a blocking pin 133 is extended into a recess 134 within a portion of the trigger 118, as shown in FIG. 10. When the plunger or blocking pin 133 has been extended and engaged within the recess 134 in the trigger 118, the trigger 118 will be securely locked and cannot be pulled back to engage the firing pin and hammer 136 against a bullet 5 ready for firing.

It is also to be understood that various types of trigger blocking mechanisms 130 may be employed which may include, but is not limited to, an electromagnetic solenoid, an electrical disabling switch, a magnetic disabling switch, and/or any other type of disabling mechanism capable of locking the trigger 118 from being pulled in accordance with systems and methods of this invention. An object of providing the trigger blocking mechanisms 130 is to prevent the unauthorized person from inadvertently pulling the trigger 118 in response to his nervous system receiving the high voltage which may cause an involuntary muscle spasm and/or other involuntary action to his body that may cause the unauthorized person to pull the trigger 118.

The disablement protection circuit 100 includes a battery, or power supply 140 in parallel with a load resistor R2 adapted to limit the current flowing from the power supply 140. The current flow across the resistor to a pair of transistors Q1 and Q2.

The transistors Q1 and Q2, take the low voltage coming across the resistor R2, and out of the power source, and controls a much larger current that is amplified and output from the various transistors Q1 and Q2. The resistor R1 is provided to protect the transistors Q1 and Q2 from too much current which may cause excessive damaging heat to the disablement protection circuit 100. The large current being output from the transistors Q1 and Q2 is fed into a drive transformer T1.

The step-up or high voltage drive transformer T1 receives a pair of currents from the transistors Q1 and Q2 which flow from a pair of primary coils induces a second current in a secondary winding. The voltage ratio is electromagnetically induced into a significantly higher level. As shown from the primary and secondary winding, the voltage is significantly boosted to a substantially higher level as shown by the dramatic increase in the number of windings in the secondary coil. The boosted secondary high voltage and smaller secondary current is fed into various diodes D1-D4.

The high voltage transformers T1, T2 (discussed later) may be of any suitable type and is well known in the art. The high output voltage from the high voltage transformer T2 may be selected to deliver a sufficiently high voltage to the electrodes 36 that will cause any person, however well motivated, to drop the weapon 10. High voltage transformers of this type are incorporated into commercial articles known as stun guns and act to deliver well in excess of 25,000 volts to the electrodes. Typical stun guns now commercially available deliver in excess of 1,000,000 volts to the electrodes.

In accordance with this invention, the unauthorized person gripping onto the handle 20 of the weapon 10 will drop the weapon 10 when experiencing excessive voltages, for example, anywhere in the range of approximately 25,000 to approximately 1,000,000 volts being delivered through their body. These ranges are not intended to be absolute and may be varied depending on the embedded circuitry, which may result in lower and/or higher ranges.

The diodes D1-D4 are arranged as a full-wave bridge rectifier to provide full-wave rectification of the AC output of the single transformer T1 secondary winding. The incoming AC from the transformer T1 is converted into some form of a pulsating DC. Both halves of the incoming AC wave are manipulated so that both halves are used to cause output current to flow in the same direction. That full-wave bridge rectifier rectifies the undulating (AC) signal (or voltage) into a single polarity (DC) signal (or voltage), hence, the diodes D1-D4 operate on the entire incoming AC wave. The full wave rectifier shown will rectify both haves of the AC signal, thereby providing a fuller, higher voltage, DC out signal. The output voltage out of the various diodes D1-D4 is fed in series to a pair of load resistors R3 and R4.

The output current from the various diodes D1-D4 is filtered. The pulsating voltage from the various diodes D1-D4 is filtered into a steady output direct current (DC) and limited across the resistor R3 and the capacitor C1.

Likewise, the current limited across the resistor R4 activates the (silicon controlled rectifier) SCR1 and is subsequently fed into the triac Z1 and collected by the capacitor C1. The triac Z1 provides internal protection to the circuit by carrying current in both directions and is used to control the AC voltage that is to switch both direct (DC) and alternating currents (AC). The SCR1 is provided to control the DC voltage coming out of the various diodes D1-D4. The SCR and the triac Z1 will provide internal protection to the circuit by further filtering out the output current in at least the following way. The triac Z1 (two SCR's back-to-back) will allow for current control in one direction and the other in the opposite polarity. On the contrary, the SCR1 will block reverse current polarity and only allow correct polarity. The SCR1 may be a high current SCR capable of switching hundreds of amperes up to several thousand volts in a predefined direction.

The output from the capacitor C1 may be fed into the diode D5 which is used to isolate current flow, like a one way valve, by controlling (blocking or passing) its flow to supply a second capacitor C2, which in turn when charged, discharges and feeds current into a second transformer T2.

The second transformer T2 receives a current which flows across a primary coil and is induced into a secondary larger winding. As shown by the windings, the voltage ratio is transformed into a significantly higher level. That is, the voltage is significantly boosted to a substantially higher level as shown by the dramatic increase in the secondary windings in the secondary coil. The highly charged voltage coming out of the secondary windings of the second transformer T2 are connected to high voltage terminals 29, which in turn may be connected to electrodes 36 as will be described later.

In an alternative embodiment, it may be possible to integrate another set of diodes (not shown) between the high output terminals 29 and the electrodes 36 to provide further protection to the authorized user, and to prevent the high voltage from backing up into the other electrical components within the disarming protection circuit 100.

As previously shown in FIGS. 1-7, the high voltage terminals 29 are simply two high voltage terminals of conducting metal positioned in the disarming protection circuit 100 with a gap between them. A high voltage differential is provided between the high voltage terminals 29. Electrodes 36 are connected through an electrode connector 38 to the high voltage terminals 29. When a portion of the unauthorized person's body (such as his hand over the grip of the weapon) fills this gap between the electrodes 36, the electrical pulses will move from one electrode conductor 36 to the other, dumping electricity into the unauthorized person's nervous system rendering him immobilized.

It should also be understood that the unauthorized person holding the weapon 10 does not necessarily have to touch the contact electrodes 33 connected to the electrodes 36 to experience the high voltage shock. Since, such a high voltage is being transmitted from the disarming protection circuit 100 through the electrodes 36 to the contact electrodes 33, and the placement of the contact electrodes 33 will be contemporaneously close to the hand (i.e. less than about an inch or two away), the high voltage passing to the contact electrodes 33 could arc into the unauthorized persons hand and cause the disabling and disarming shock at that short distance without the contact electrodes 33 actually contacting the skin of the unauthorized person.

In accordance with this invention, the electrodes 36 and the contact electrodes 33 may be installed within the weapon 10 with minimal modification to the handle 20. That is, various small holes may be drilled into the handle 20 and the contact electrodes 33 may be located in position within the various holes as shown in FIGS. 1-7. The electrodes 36 may then be extended along an inside wall (as shown in FIG. 4) of a magazine receiving channel 21 to the contact electrodes 33 disposed in the handle 20 of the weapon 10.

As shown in FIG. 8 and described in more detail later in FIG. 11, the electrodes 36 extending from the high voltage terminals 29 may be connected to a holster 63. That is, the high voltage electrodes 36 may be insulated through the belt 62 and into the holster 63 for use. Likewise, the high voltage electrodes 36 may be electrically connected to an electrode covering 90 electrically integrated on the weapon 10. The high voltage output transferred from the output terminals 29 to the high voltage electrodes 36 may produce an output upwards of 50,000 to 1,000,000 volts of electricity, and/or higher as described above.

The objective of wiring the high voltage electrodes 36 into the holster 63 and/or weapon 10 is to disrupt the body's electrical system. The shock generated by the disarming protection circuit 100 is a high-voltage, low-amperage electrical charge. The charge administered to the body has a lot of pressure behind it. When the disarming protection circuit 100 is activated against an unauthorized individual, the charge passes into the unauthorized individual's body. As a result of delivering such a high voltage, the charge will pass through heavy clothing and skin. The charge administered by the disarming protection circuit 100 can be adjusted to do more, or less, damage to the unauthorized individual's body. The unauthorized individual's nervous system is shocked, confused and unbalanced, and may even be partially paralyzed, albeit temporarily.

Figure 13:
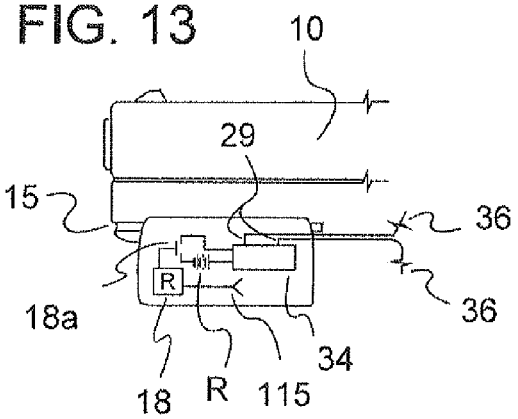
FIG. 13 illustrates an exemplary embodiment for the rail mounted housing assembly including the disarming protection circuit in accordance with this invention.

FIGS. 12-13 depict a rail mounted housing 70 including the disarming protection circuit 100. FIG. 13 illustrates the disarming protection circuit 100 being embodied within a rail mounted housing 70. In operation, the rail mounted housing 70 is secured onto the rail 15 of the weapon 10. A pair of electrodes 36 extend from the high voltage output terminals 29 in the disarming protection circuit 100 within the rail mounted housing 70 along the surface of the weapon 10 to an area adjacent to the handle 20.

Figure 14:
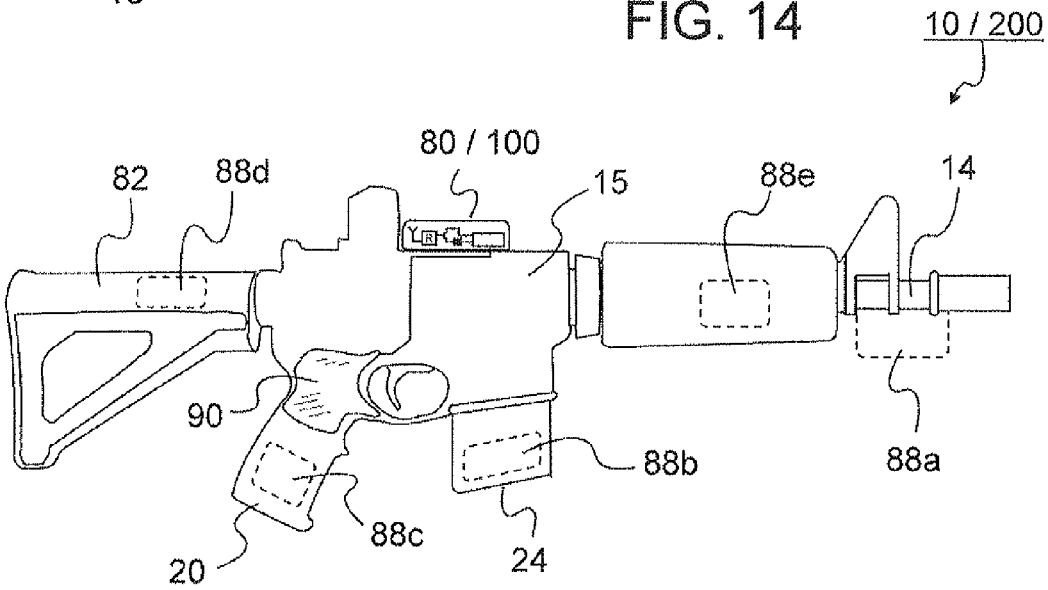
FIG. 14 depicts an exemplary embodiment for a rifle includes a housing disposed with the disarming protection circuit in accordance with this invention.

FIG. 14 illustrates another exemplary location for a rail mounted housing 80 configuration adapted for use on a rifle 200 including a disarming protection circuit 100 in accordance with this invention. It is to be understood that the rail mounted housing 80 and disarming protection circuit 100 may be secured to any suitable location on a weapon. For example, the rail mounted housing 80 and disarming protection circuit 100 (as shown herein as 88*a*, 88*b*, 88*c*, 88*d* and 88*e*) may be integrated on a rail 15, the butt 82 of the rifle 200, the handle 20, the magazine 24, the barrel 14, and/or any other suitable location on the weapon.

As similarly applied to FIG. 14, and mentioned with respect to FIGS. 12-13, the electrodes 36 may be extended from the disarming protection circuit 100 in the rail mounted housing 80 to any suitable location where the hand and/or any portion of the body of the person holding the rifle 200 will make contact. Likewise, the electrodes 36 may be extended to various conductive coverings 90 (which will be described later) which may be integrated onto the rifle 200 in accordance with systems and methods of this invention.

FIGS. 11, 12 and 14 illustrate another exemplary embodiment in which conducting coverings 90 are affixed to a weapon 10. The conducting coverings 90 are electrically connected to the disarming protection circuit 100 via the electrodes 36.

The conductive covering 90 may be made from a variety of different materials capable of being molded to various surfaces on a weapon 10. The conductive covering 90 is preferably composed of a metallic conductive material, such as a metal, a conductive composite and/or any other sheath type material that can be easily molded over the surface of a weapon 10 and possess electrical conductive properties.

FIG. 12 depicts a conducting covering 90 fastened to an exterior portion of the weapon 10. As shown, the conducting covering 90 is fastened onto a portion of the handle 20 of the weapon 10. The conducting covering 90 is electrically connected to the electrodes 36 that extend from the disarming protection circuit 100. In use, the conducting covering 90 functions as an electrical extension of the electrodes 36 that covers a substantially larger area in which may come into contact with a portion of the user's hand or body.

When the disarming protection circuit 100 is activated and the electrodes 36 are charged, the high voltage source electrically conducts from the electrodes 36 into the conducting coverings 90 thereby extending the conductive coverage upon which the users hand may be placed when holding the weapon.

FIG. 12 further demonstrates the electrodes 36 being extended from a rail mounted housing 70 that includes the disarming protection circuit 100. The conducting covering 90 is secured over an exterior portion of the weapon 10 and extends from an area adjacent to the rail mounted housing 70. The conducting covering 90 is electrically connected to the electrodes 36, which in turn extend out from within the rail mounted disarming protection circuit 100 and are electrically connected to the high voltage output terminals 29.

According to this embodiment, the conducting covering 90 extend outward from the disarming protection circuit 100 and wrap over a portion of the trigger guard 19 and the handle 20 of the weapon 10. The conducting covering 90 is electrically connected to the electrodes 36 connected to the disarming protection circuit 100. Although the electrode 36 is shown extending from under the trigger guard 19 region to the conducting covering 90, it is also understood that the electrode 36 may be extended over the top of the trigger guard 19 to the conducting covering 90 disposed on the handle 20.

It is to be understood that the conducting covering 90 may provide covering over any portion of the weapon 10, and may take any number of various shapes. The conducting covering 90 may be made of a flexible conductive material capable of being flexibly overlaid over any surface of any weapon, now known or later discovered, in accordance with this invention.

FIG. 11 illustrates another exemplary embodiment in accordance with systems and methods of this invention. In particular, FIG. 11 depicts the disarming protection circuit 100 being used with a holster assembly in accordance with this invention. As shown, the holster system 300 includes a disarming protection circuit 100 adapted for use with a weapon 10 including a conducting covering 90 disposed thereon. The weapon 10 is disposed within a holster 63 incorporating the disarming protection circuit 100 in accordance with this invention.

In particular, the holster system 300 includes a belt 62 and a holster 63. The holster 63 may, or may not, include a fastener, such as a snap fastener strap 64 to secure the weapon 10 within the holster 63. The holster 63 is constructed to receive the weapon 10 and may, or may not include, at least, a barrel receiving portion 65 and a trigger receiving portion 66. As shown, the handle 20 is uncovered and easily accessible in order to withdraw the weapon 10 when needed for use.

The disarming protection circuit 100 may be integrated at various places in the holster system 300. As shown in FIG. 11, the disarming protection circuit 100 may be integrated on the belt 62 or on the holster 63. If the disarming protection circuit 100 is integrated onto the belt 62, the electronics of the disarming protection circuit 100 may be disposed in a belt electronics housing compartment 67*a* that is electrically connected into the holster 63, which in turn is electrically connected to the conducting covering 90 on the weapon 10.

If, in the alternative, the disarming protection circuit 100 is integrated directly into the holster 63, the holster 63 and the electronics of the disarming protection circuit 100 are self contained in a holster electronics housing compartment 67*b* integrated onto the holster 63. As such, the holster 63 may be sold and/or distributed without the belt 62 since the entire first portion of the disarming protection circuit 100 is self contained within the holster electronics housing compartment 67*b* of the holster 63.

FIG. 11 depicts at least two configurations in which the disarming protection circuit 100 may be integrated into the holster system 300. In a first embodiment, the disarming protection circuit 100 is integrated into a belt electronics housing compartment 67*a* in the belt 62 and is electrically connected to the holster 63. The disarming protection circuit 100 may be integrated in a variety of different ways, including but not limited to, within the belt 62, on an outside, and/or on an inside of the belt 62.

As shown, a first portion of the disarming protection circuit 100 is disposed on the holster system 300, and a second portion of the disarming protection circuit 100 is integrated onto the weapon 10. The circuitry previously described with respect to the disarming protection circuit 100 is similar in function and use. In FIG. 11, in a first embodiment, a tethered actuator 120 is shown is electrically connected to the disarming protection circuit 100 disposed in the belt electronics housing compartment 67*b*. A pair of electrodes 36 are shown extending from the disarming protection circuit 100 to the holster 63.

The actuator 27 is constructed in the form of a remote push button switch 120 that generates an instruction signal to provide a high voltage current source to the output in the disarming protection circuit 100. Electrodes 36 are electrically connected to, and extend from, the output terminals 29 in the first portion of the disarming protection circuit 100 to a contact electrode 33 exposed inside of the holster 63 that holds the weapon 10.

A second portion of the disarming protection circuit 100 is disposed on the weapon 10. The weapon 10 includes a conductive covering 90 secured to the surface of the weapon 10. The conductive covering 90 is electrically connected to the contact conductor 33 exposed inside of the holster 63. A surface of the conductive covering 90 is disposed in juxtaposition to the contact conductor 33. The conductive covering 90 extends from a location adjacent to the contact conductor 33 near the grip of the weapon 10. The conductive covering 90 is laid over and fastened to a portion of a grip 22 of the handle 20 of the weapon 10. It is to be understood that the conductive covering 90 may be placed over any surface on the weapon 10, preferably where a user of the weapon will grip the weapon 10, and/or where their body will come into contact with the weapon 10.

Referring to FIGS. 9-11, in operation, when the push button switch 120 on the holster 63 is depressed and the actuator 27 is activated, a trigger blocking mechanism 130 may be activated to lock the trigger 18 so that the weapon 10 cannot be fired. Likewise, when the actuator 27 is activated, an instruction signal is generated and delivered to produce the high voltage output through the output terminals 29 in the disarming protection circuit 100 to the electrodes 36 through the conductor ends 33 disposed in the holster 63 and into the conductive covering 90 on the weapon 10. A high voltage output is delivered through the conductive covering 90 with a sufficient non-lethal shock to cause the unauthorized person to release their grip on the weapon 10.

At least two other exemplary embodiments are shown in which the disarming protection circuit 100 is integrated directly into a holster electronics housing compartment 67*b* on the holster 63. In use, when the push button switch 120 is depressed, an instruction signal is generated that provides a high voltage source to the output in the disarming protection circuit 100. Electrodes 36*a* are electrically connected to, and extend from, the output terminals 29 in the first portion of the disarming protection circuit 100 to the contact electrode 33 exposed inside of the holster 63 that secures the weapon 10.

As described before, the contact electrode 33 is electrically connected to the conductive covering 90 so when triggered, the high voltage current source will energize the conductive covering 90 delivering the high voltage current to the unauthorized person attempting to pull the weapon 10 from the holster 63.

In the second exemplary embodiment shown, the disarming protection circuit 100 is provided in a holster electronics housing compartment 67*c*. To activate, an actuator 27 remotely located may be selected that generates a wireless instruction signal to provide a high voltage source to the output terminals 29 in the disarming protection circuit 100.

When activated, the electrodes 36*b* are electrically connected to, and extend from, the output in the first portion of the disarming protection circuit 100 to the contact electrode 33 exposed inside of the holster 63 that secures the weapon 10. As before, the contact electrode 33 is electrically connected to the conductive covering 90 so that the high voltage current source will energize the conductive covering 90 delivering the high voltage current to the unauthorized person attempting to pull the weapon 10 from the holster 63.

It is to be understood that the disarming protection circuit 100 and other features according to systems and methods of this invention may be integrated into various tools conventionally used as a weapon 10 by a law enforcement officer, such as for example: a baton, a flashlight, and the like.

FIG. 15 illustrates another exemplary embodiment employing an electrode circuit 37 integrating various multi contact points 33*a*, 33*b*, 33*c*, 33*d*, 33*e* on the weapon 10. The advantage of constructing a single electrode circuit 37 integrating the various multi contact points 33*a*, 33*b*, 33*c*, 33*d*, 33*e* is that the single circuit 37 may be provided contiguously on a single weapon 10, and may be adapted for use with the various exemplary embodiments in which the disarming protection circuit 100 may be provided as described herein.

FIG. 15 shows the electrode circuit 37 integrated with a weapon 10 and including various multi contact points 33*a*, 33*b*, 33*c*, 33*d*, 33*e*. As described before, a pair of contact electrodes 33*a* may be disposed on the handle 20 of the weapon 10 at approximately the location of the grip 22 on the handle 20. However, it is to be understood that the contact electrodes 33*a* may be disposed on the handle 20 at various locations. By way of example, the contact electrodes 33*a*, 33*b* are shown in at least two different positions. In both positions, the contact electrodes 33*a*, 33*b* are shown suitably provided in an optimum position in which the hand of the unauthorized user will come into contact with the contact electrodes 33*a*, 33*b* when the weapon 10 is gripped.

Figure 16:
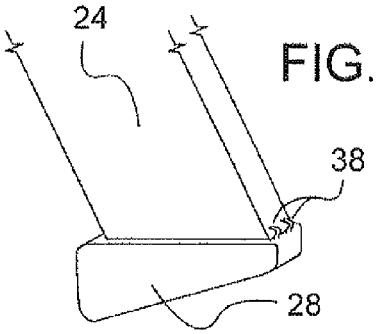
FIG. 16 depicts another exemplary arrangement for the electrical connection for the magazine in accordance with this invention.

FIG. 16 depicts a pair of electrode connectors 38 positioned to be electrically connected to a first set of contact electrode points 33*c* provided at the bottom end of the handle 20, as shown in FIG. 15. These electrode connectors 38 allow the disarming protection circuit 100, embedded within the extension 28 of the magazine 24, to be electrically connected with the electrode circuit 37.

Contact electrodes points 33*d* are provided at the forward end of the weapon 10 to correspond to the position in which the disarming protection circuit 100 is housed within a rail housing 70 (as shown in FIGS. 12-13). In operation, when the rail housing 70 is secured to the rail 15, the output terminal 29 of the disarming protection circuit 100 is electrically connected to the contact electrode points 33*c*, and is ready for use. Similar electrode connectors 38 may be integrated onto the rail housing 70 to establish the electrical connection between the disarming protection circuit 100 in the rail housing 70 and the electrode circuit 37 on the weapon 10.

Contact electrodes points 33*e* are provided at a position approximately corresponding to the holster contact electrode 31 disposed on an interior side of the holster 63 adjacent to the weapon 10. More specifically, the contact electrodes points 33*e* correspond to the connection made when the disarming protection circuit 100 is embedded within the holster housing 67*a*, as shown in FIG. 11.

It is an aspect of this invention to integrate the electrode circuit 37 having the various multi contact points 33*a*, 33*b*, 33*c*, 33*d*, 33*e* into the weapon 10 in variety of different ways. For example, the electrode circuit may be directly integrated into the mold of the weapon 10 so that only various multi contact points 33*a*, 33*b*, 33*c*, 33*d*, 33*e* are exposed from the exterior of the weapon 10. Likewise, the electrode circuit 37 may be integrated on an inside of the weapon 10 and the various multi contact points 33*a*, 33*b*, 33*c*, 33*d*, 33*e* may protrude through the housing of the weapon 10. By covering the multi contact points 33*a*, 33*b*, 33*c*, 33*d*, 33*e* of the electrode circuit 37, the electrode circuit 37 will be protected from being damaged and/or broken.

Figure 17:
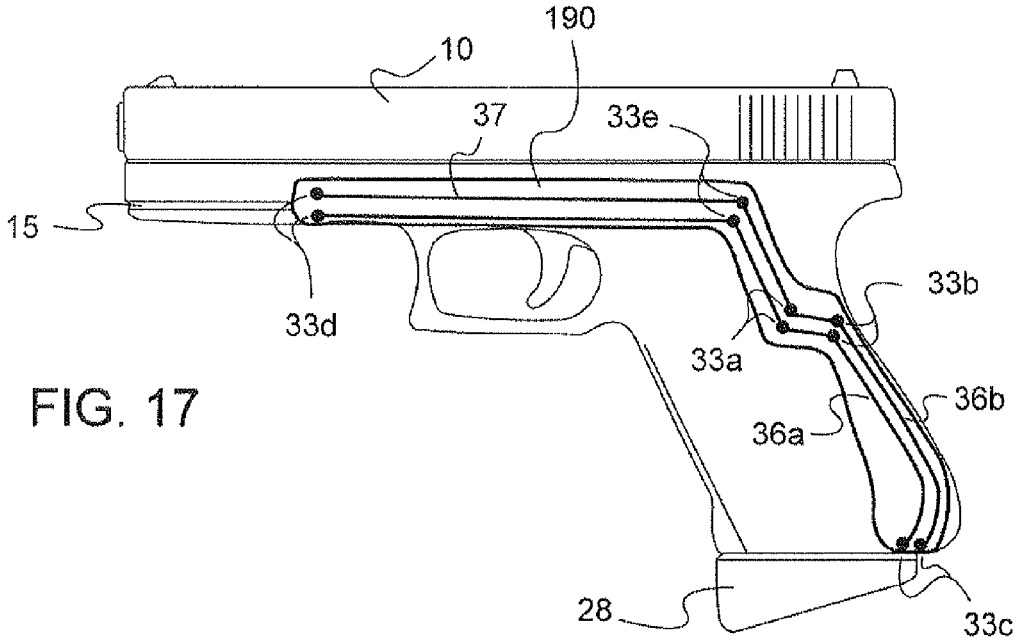
FIG. 17 illustrates a covering including the electrode circuit integrated with the weapon in accordance with this invention.

FIG. 17 depicts yet another exemplary illustration in which the electrode circuit 37 and its various contact points 33*a*, 33*b*, 33*c*, 33*d*, 33*e* are embedded within a covering 190, or the like. The covering 190 may be made from a flexible conductive material capable of being flexibly overlaid over any surface of any weapon to enhance the conduction of the high voltage source, now known or later discovered, in accordance with this invention.

Alternatively, since the electrode circuit 37 is already conductive, it is possible to select a material for the conductive covering 90 which does not possess conductive qualities, but instead is selected from an insulated material adapted to insulate the electrode circuit 37 up to, but not including, the various contact points 33*a*, 33*b*, 33*c*, 33*d*, 33*e*. Other implements may be used in accordance with this invention in which to construct the conductive covering 90.

According to another aspect of the invention, a method is provided to control the operation of a weapon including a disarming protection circuit. An authorized person may prevent the operation of the weapon in the hands of the unauthorized person by causing the disarming protection circuit to activate a trigger blocking mechanism that inhibits the trigger from being pulled.

The authorized person may also cause a high voltage current to be generated by the disarming protection circuit in the weapon. The high voltage current generated may be delivered to through a conductor disposed in a grip of the weapon which would deliver a sufficient non-lethal shock to cause the unauthorized person to release their grip on the weapon.

The method provides a first portion of a circuit in a housing. The first portion of the circuit may be constructed and/or embedded within the weapon in a non removable manner.

Likewise, the first portion of the circuit may be embedded with a removable housing. The removable housing may include, but is not limited to, a magazine, a rail mounted housing, and/or any other removable component which may be attached to the weapon.

A second portion of the circuit is electrically connectable to the first portion of the circuit. The electrical connection between the first portion of the circuit and the second portion of the circuit may be made at a conductor connection. From the second portion of the circuit, at least one high voltage electrode may extend there from onto a grip of the weapon.

During operation, a switch may be actuated in which the trigger may be blocked and/or the high voltage may be generated. That is, in response to the actuation of the switch, a high voltage current source is generated in the first portion of the circuit. The high voltage current source is then delivered from an output in the first portion of the circuit across the conductor connection and into the second portion of the circuit. In the second portion of the circuit, the high voltage current source is electrically communicated into a high voltage electrode. The high voltage electrode may be extended from the connector connection onto the grip of the weapon.

The high voltage current source is delivered through the high voltage electrode into the body of the unauthorized user with a sufficient shock to cause a person to release the weapon.

In accordance with this method, the disarming protection circuit may include a remote switch. The remote switch may be adapted to communicate with a radio receiver/transceiver that is equipped and adapted to receive a signal in response to the activation of the switch. The signal may be produced at a distinctive high frequency signal that the radio receiver/transceiver will receive.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. An immobilizing and disarming control system for a weapon including a barrel having a muzzle, a trigger and a handle, the control system comprising a modular high voltage producing circuit component comprising:

a first portion of the high voltage producing circuit in a housing including a high voltage power source, a receiver for receiving a signal from a transmitter and providing a high voltage output via an electrode that extends toward an outer portion of the weapon;

a second portion of the high voltage producing circuit including a conductor assembly including a conductive covering electrically connected to the electrode, the conductive covering being overlaid onto a portion of the weapon; and in response to a switch being activated, an actuator produces the signal that causes the first portion of the high voltage producing circuit to generate and deliver the high voltage output through the electrode to the conductive covering generating a sufficient high voltage shock to cause a person to release the weapon, wherein the conductive covering is electrically connected to another electrode conductor connection provided inside of a pouch of a holster, wherein when the weapon is placed in the holster, a surface of the conductive covering over the weapon is in juxtaposition to the another conductor connection within the pouch of the holster such that when the switch is activated, the high voltage shock is transferred into the conductive covering causing a person gripping the weapon to release the weapon.

2. The immobilizing and disarming control system recited in claim 1, where in response to the switch being activated, a trigger blocking mechanism locks the trigger so that the weapon cannot be fired.

3. The immobilizing and disarming control system recited in claim 1, wherein the first portion of the high voltage producing circuit is contained in the housing provided in at least one of the following locations of the weapon: on a rail of the weapon or in a magazine connected to the weapon.

4. A weapon including a barrel having a muzzle, a trigger, and a handle, comprising:

a high voltage producing circuit provided in a removable magazine clip including a first portion of a circuit comprising: a high voltage source, a receiver for receiving a signal from a transmitter and providing an output;

a conductor assembly comprising a second portion of the circuit, wherein an electrode extends over the handle, the electrode extending from a lower end of the handle adjacent to an opening adapted to receive the removable magazine clip, wherein a first end of the electrode is electrically connected to a conductor connection disposed on the removable magazine clip adjacent to the output of the first portion of the circuit, and a second end of the electrode extends over the handle and exposed thereon; and an actuator that generates the signal to connect the high voltage source in the circuit with the electrode in response to the output from the receiver to provide a high voltage current source in the high voltage circuit producing circuit with a sufficient shock to cause a person to release the weapon, wherein the electrode is attached and electrically connected to a conductive sheath that covers a portion of the weapon, and wherein the conductive sheath is electrically connected to another conductor connection provided inside of a pouch of a holster, such that a surface of the conductive sheath is in juxtaposition to the other conductor connection within the pouch and wherein the conductive sheath extends over an external surface of the weapon.

5. The weapon recited in claim 4, wherein the electrode is a pair of electrodes exposed on the handle.

6. The weapon recited in claim 4, wherein the conductor assembly is disposed on, and extends along, an outer wall of the handle to a predetermined position on the weapon.

7. The weapon recited in claim 4, wherein the first portion of the circuit is housed within an extension portion of the magazine.

8. The weapon recited in claim 4, wherein the high voltage source has the capacity to deliver voltage in the range from approximately 25,000 volts to 1,000,000 volts to the electrode.

9. The weapon recited in claim 4, wherein the transmitter is a remote transmitter that wirelessly communicates the signal to the receiver.

10. An automatic weapon including a barrel having a muzzle, a trigger, a magazine and a handle, comprising:

a high voltage producing circuit provided in a removable rail mounted housing including a first portion of a high voltage producing circuit comprising: a high voltage power source, a receiver for receiving a signal from a transmitter and providing a high voltage output;

a conductor assembly comprising a second portion of the high voltage producing circuit, wherein an electrode extends from the removable rail mounted housing to a grip on the weapon, and wherein a first end of the electrode is electrically connected to a conductor connection that is electrically connected to the output of the first portion of the high voltage producing circuit; and in response to a switch being activated, an actuator produces the signal that generates the high voltage output through the conductor connection to the electrode with a sufficient shock to cause a person to release the weapon.

11. The automatic weapon recited in claim 10, wherein when the switch is activated, a trigger blocking mechanism locks the trigger so that the weapon cannot be fired.

12. The automatic weapon recited in claim 10, wherein the electrode is attached and electrically connected to a conductive covering.

13. The automatic weapon recited in claim 12, wherein the conductive covering is attached to a surface of the weapon, and where in response to the switch being activated, the high voltage current source produced is electrically connected through the conductor connection into the conductive covering on the weapon producing the shock that disables the person causing them to release the weapon.

14. The automatic weapon recited in claim 12, wherein the conductive covering is electrically connected to a conductor connection provided inside of a pouch of a holster, such that a surface of the conductive covering is juxtaposition to the conductor connection within the pouch and wherein the conductive sheath extends over a portion of the weapon.

15. The automatic weapon recited in claim 12, wherein the conductive covering is disposed over the grip of the handle of the weapon.

16. The automatic weapon recited in claim 12, wherein the conductive covering is disposed over any surface portion of the weapon.

17. The automatic weapon recited in claim 10, wherein the transmitter is a remote transmitter that wirelessly communicates the signal to the receiver.

* * * * *